US008844623B2

(12) United States Patent
Nguyen

(10) Patent No.: US 8,844,623 B2
(45) Date of Patent: Sep. 30, 2014

(54) METHOD AND SYSTEM FOR ONE-TRIP HANGER INSTALLATION

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 671 days.

(21) Appl. No.: 13/130,301

(22) PCT Filed: Jan. 12, 2010

(86) PCT No.: PCT/US2010/020821

§ 371 (c)(1),
(2), (4) Date: May 19, 2011

(87) PCT Pub. No.: WO2010/088037

PCT Pub. Date: Aug. 5, 2010

(65) Prior Publication Data

US 2011/0226490 A1 Sep. 22, 2011

Related U.S. Application Data

(60) Provisional application No. 61/147,978, filed on Jan. 28, 2009.

(51) Int. Cl.

| | |
|---|---|
| ***E21B 33/04*** | (2006.01) |
| ***E21B 33/043*** | (2006.01) |
| ***E21B 33/035*** | (2006.01) |

(52) U.S. Cl.

CPC ..... *E21B 33/035* (2013.01); *E21B 33/04* (2013.01); *E21B 33/043* (2013.01)

USPC ..... 166/210; 166/382; 166/208

(58) Field of Classification Search

CPC ..... E21B 33/043
USPC ..... 166/208, 210, 212, 290, 382
See application file for complete search history.

(56) References Cited

U.S. PATENT DOCUMENTS

| | | | | |
|---|---|---|---|---|
| 3,661,206 | A | 5/1972 | Putch et al. | |
| 3,809,158 | A | 5/1974 | Bonds et al. | |
| 3,897,823 | A * | 8/1975 | Ahlstone | 166/120 |
| 4,634,152 | A * | 1/1987 | Pettit | 285/39 |
| 4,674,576 | A * | 6/1987 | Goris et al. | 166/382 |
| 4,969,517 | A * | 11/1990 | Valka et al. | 166/208 |
| 5,069,288 | A | 12/1991 | Singeetham | |
| 2002/0174991 | A1 | 11/2002 | Borak | |

FOREIGN PATENT DOCUMENTS

GB 2218444 11/1989

OTHER PUBLICATIONS

PCT Search Report and Written Opinion of PCT Application No. PCT/US2010/020821 mailed Aug. 2, 2010.
GB Examination Report on Application No. GB1112869.1, dated Sep. 28, 2012.

* cited by examiner

*Primary Examiner* — William P Neuder
*Assistant Examiner* — Richard Alker
(74) *Attorney, Agent, or Firm* — Fletcher Yoder P.C.

(57) ABSTRACT

There is provided a system and method for installing a wellhead component in a single trip. Generally, a wellhead component may be run into a wellhead using a running tool. The running tool may then be retrieved from the wellhead and replaced with a locking tool, which is also run into the wellhead. Additional tools may be used to over-pull the wellhead component and to cementing the wellhead component in place. The process of retrieving and running tools into the wellhead is both time-consuming and costly. Accordingly, the disclosed embodiments include a one-trip tool configured to run a wellhead component into a wellhead, engage an internal coupling to lock the wellhead component in place, over-pull the wellhead component to ensure the internal coupling was properly engaged, and cement the wellhead component in place within the wellhead.

20 Claims, 8 Drawing Sheets

METHOD AND SYSTEM FOR ONE-TRIP HANGER INSTALLATION

CROSS-REFERENCE TO RELATED APPLICATIONS

This application claims priority to and benefit of PCT Patent Application No. PCT/US2010/020821, entitled "Method and System for One-Trip Hanger Installation," filed Jan. 12, 2010, which is herein incorporated by reference in its entirety, and which claims priority to and benefit of U.S. Provisional Patent Application No. 61/147,978, entitled "Method and System for One-Trip Hanger Installation", filed on Jan. 28, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

A long pipe, such as a casing, may be lowered into the earth to enable access to the natural resource. The casing may be secured within the wellhead by a hanger. In some instances, internal couplings may be used to secure components of the wellhead together, such as to secure the hanger within the wellhead. In such cases, the wellhead component, such as the hanger, is generally run into the wellhead using a running tool then locked in place using an additional tool designed to engage the internal coupling. This process may involve retrieving the running tool from the wellhead, replacing the running tool with a locking tool, and running the locking tool into the wellhead. The process of retrieving and running tools into the wellhead is both time-consuming and costly. In addition, further tools may be run into the wellhead to perform additional operations, such as over-pulling the wellhead component to ensure it is secured within the wellhead and cementing the wellhead component in place. Accordingly, it may be desirable to provide a tool with which multiple operations may be performed in a single trip (i.e., without retrieving, replacing, and running additional tools).

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present technique include a system and method that addresses one or more of the above-mentioned challenges of installing wellhead components in a wellhead. As explained in greater detail below, the disclosed embodiments include a one-trip tool configured to run a wellhead component into a wellhead, engage an internal coupling to lock the wellhead component in place, over-pull the wellhead component to ensure the internal coupling was properly engaged, and cement the wellhead component in place within the wellhead. Previous tools may have performed only a single operation before being retrieved and replace with another tool to perform another operation.

Figure 1:
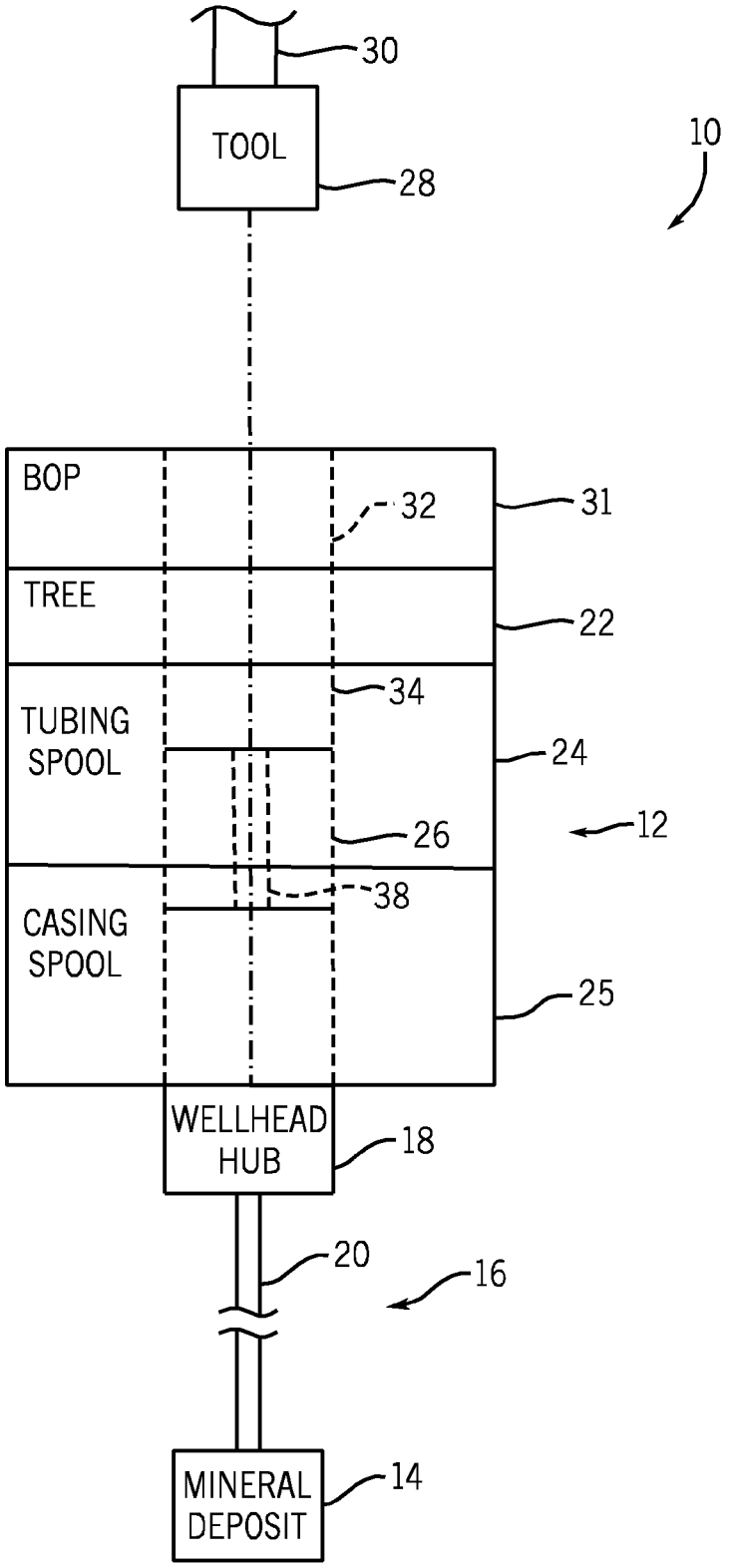
FIG. 1 is a block diagram illustrating a mineral extraction system in accordance with an embodiment of the present invention.

FIG. 1 is a block diagram that illustrates an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 25, and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and so forth. The hanger 26 includes a hanger bore 38 that extends through the center of the hanger 26, and that is in fluid communication with the tubing spool bore 34 and the well bore 20. One or more seals, such as metal-to-metal seals, may be disposed between the hanger 26 and the tubing spool 24 and/or the casing spool 25.

Figure 2:
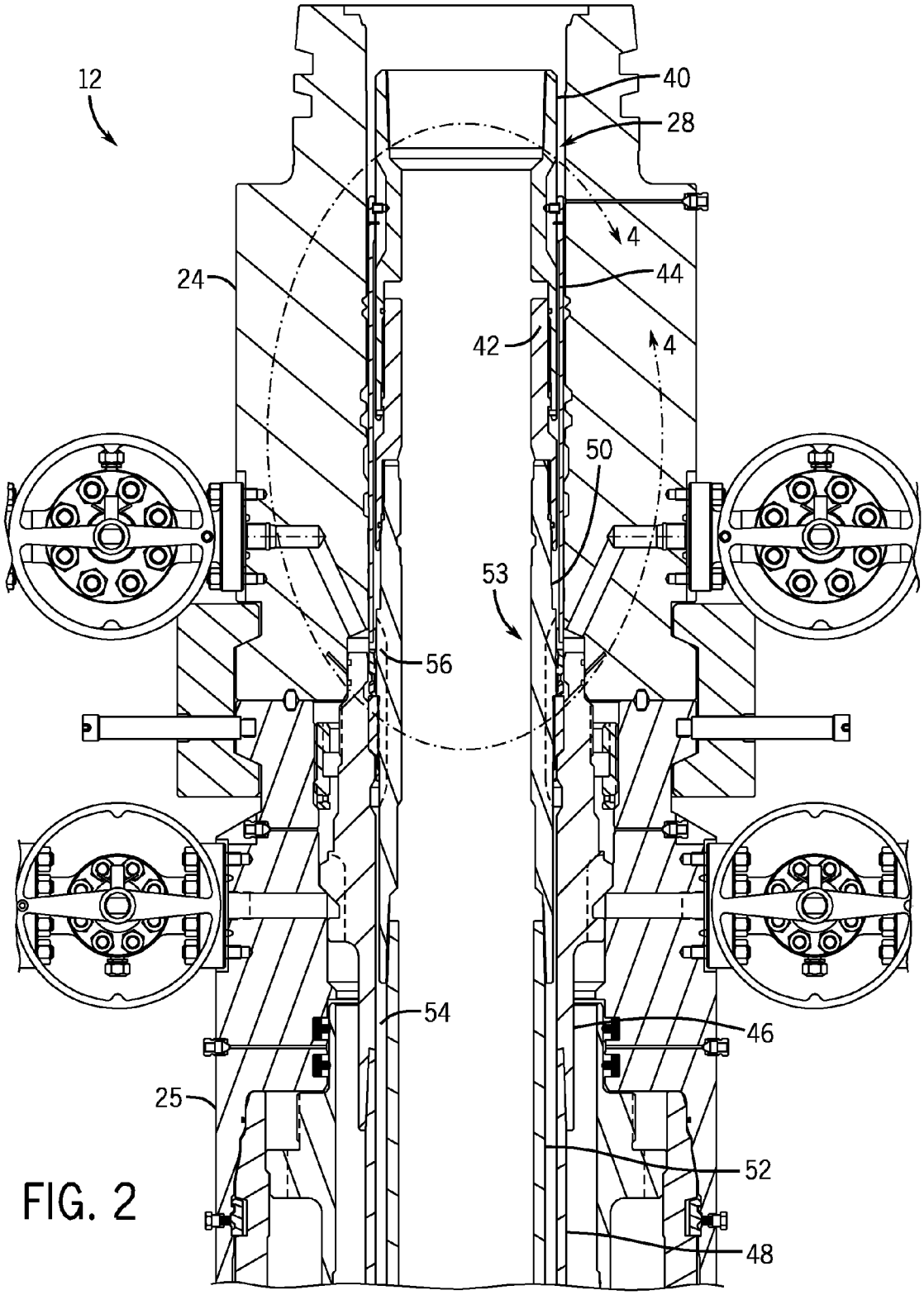
FIG. 2 is a cross-sectional view of exemplary wellhead components in a configuration in accordance with an embodiment of the present invention.

FIG. 2 illustrates exemplary embodiments of the tubing spool 24, the casing spool 25, the hangers 26, and the running tool 28. In the illustrated embodiment, the running tool 28 may perform several functions in addition to running wellhead components into the wellhead 12. Accordingly, the tool 28 may be more appropriately considered a one-trip tool 28, which includes an upper tool portion 40, a lower tool portion 42, and an energizing sleeve 44. The components of the exemplary one-trip tool 28 are illustrated in greater detail in FIG. 3.

Referring again to FIG. 2, a first hanger 26 may be a casing hanger 46, from which a casing 48 extends. A second hanger 26 may be a tubing hanger 50 from which a tubing 52 extends. In other embodiments, various number/combinations of hangers may be utilized. The casing hanger 46 may be disposed within and coupled to the casing spool 25. The tubing spool 24 may be landed axially above the casing spool 25. In the illustrated embodiment, the tubing hanger 50 may be disposed within and coupled to the casing hanger 46 via a coupling 53, as described in more detail below. In other embodiments, the tubing hanger 50 may be coupled directly to the tubing spool 24 or to another wellhead component. The tubing 52 may be disposed concentrically within the casing 48, with an annular space 54 defined therebetween. During a cementing process, cement may be piped down the tubing 52, through a cementing valve (not shown), and back up the casing 48 in the annular space 54. Cement may also, or alternatively, be disposed around the exterior of the casing 48. The cement process may fix the tubing 52 and/or the casing 48 in place within the wellhead 12 even under the very high pressures present during mineral extraction. In addition, to facilitate the flow of cement up the annular space 54 past the coupling 53, the tubing hanger 50 may have a fluted exterior 56. For example, the fluted exterior 56 may include one or more shallow grooves which run in an axial direction along the exterior of the tubing hanger 50. In another embodiment, the tubing hanger 50 may have a uniform exterior with flow-through bores (not shown). The flow-through bores may be generally axial holes in the wall of the tubing hanger 50, with openings to the annular space 54 both axially above and below the coupling 53 to enable fluid flow therethrough.

Figure 3:
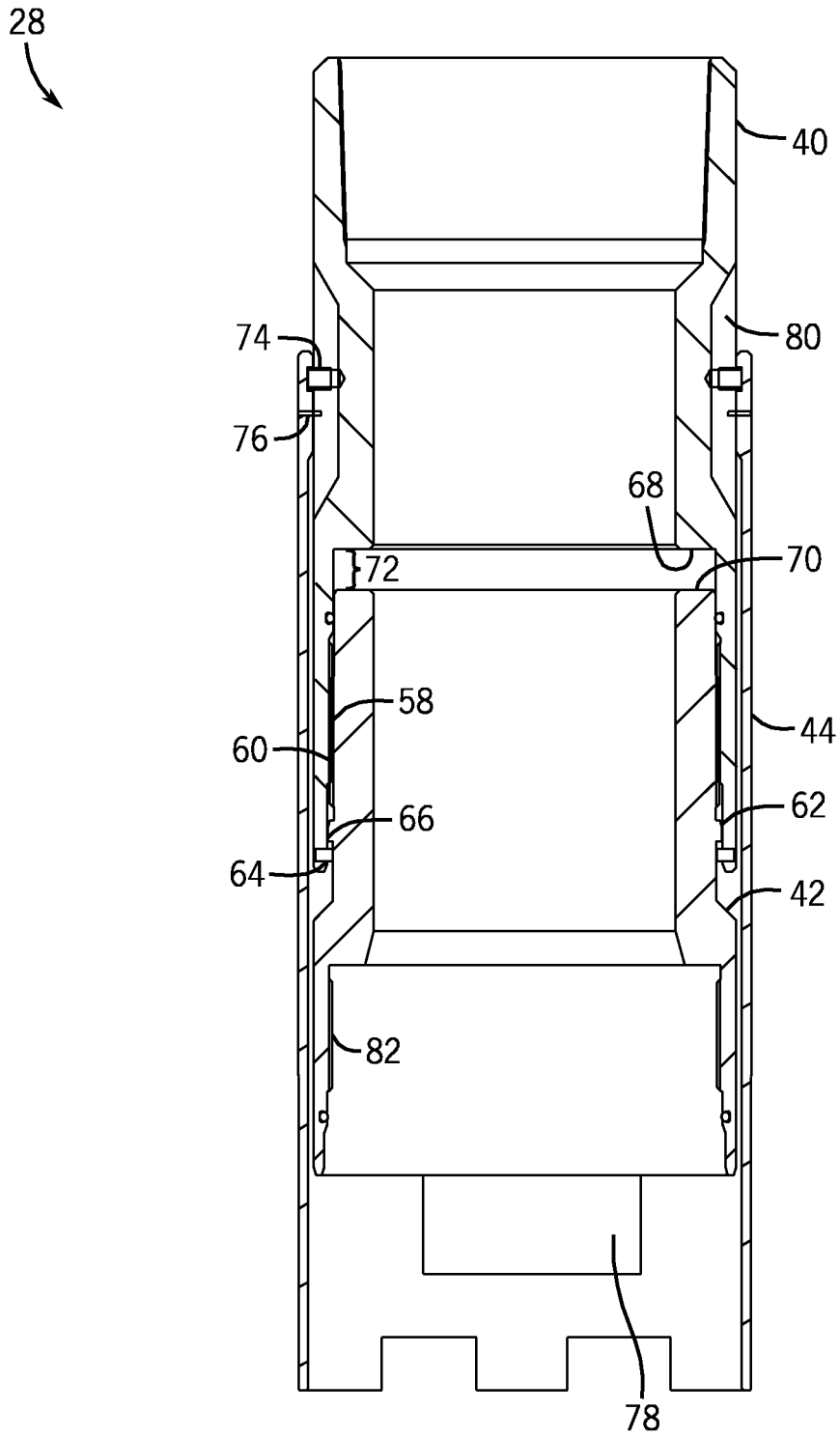
FIG. 3 is a cross-sectional view of the one-trip tool of FIG. 2 in accordance with an embodiment of the present invention.

In operation, the one-trip tool 28 may be used to run the tubing hanger 50 into the wellhead 12, lock the tubing hanger 50 to the casing hanger 46, over-pull the tubing hanger 50 to verify that it is locked in place, and cement the tubing hanger 50 in place within the wellhead. Turning to FIG. 3, various components of the one-trip tool 28 which enable such functionality are described in more detail. As discussed above, the one-trip tool 28 includes the upper tool portion 40, the lower tool portion 42, and the energizing sleeve 44. The upper tool portion 40 may be coupled to the lower tool portion 42 via complimentary female threading 58 and male threading 60 on the upper and lower tools 40 and 42, respectively. The upper tool 40 may be axially adjustable with the lower tool 42 via the threading 58 and 60. A radial protrusion 62 from the lower tool 42, in conjunction with a pin 64 disposed in the upper tool 40, may block axial separation of the upper and lower tools 40 and 42. That is, a shoulder 66 on the protrusion 62 may abut the pin 64 protruding radially inward from the upper tool portion 40, thereby blocking axial movement of the upper tool 40 with respect to the lower tool 42 past a certain point.

In addition, the upper and lower tools 40 and 42 may be moved together axially only until a lower end 68 of the upper tool portion 40 abuts an upper end 70 of the lower tool portion 42. A gap 72 is defined between the lower end 68 and the upper end 70.

The upper tool portion 40 is also coupled to the energizing sleeve 44. The sleeve 44 may be a thin, cylindrical object disposed around the upper and lower tool portions 40 and 42. One or more set screws 74 may couple the sleeve 44 to the upper tool portion 40 such that the sleeve 44 is axially fixed relative to the upper portion 40. For example, movement of the upper portion 40 with respect to the lower portion 42 (i.e., via threading the portions together) also moves the sleeve 44 relative to the lower portion 42. In addition, one or more shear pins 76 fix the sleeve 44 rotationally relative to the upper tool portion 40. That is, rotation of the upper portion 40 also rotates the sleeve 44 while the shear pins 76 are intact. As described in more detail below, the shear pins 76 may be sheared by excessive rotational force such that the sleeve 44 and the upper tool 40 may rotate with respect to one another.

Further, the one-trip tool 28 includes features to enable cement to flow therethrough. For example, the sleeve 44 may have one or more flow-through slots 78, and the upper tool portion 40 may have a fluted exterior 80 (e.g., the upper tool portion 40 may have one or more shallow grooves extending vertically along its exterior 80) or generally axial flow-through bores. In addition, the one-trip tool 28 may be coupleable to the tubing hanger 50 via female threading 82 on an interior of the lower tool portion 42. The female threading 82 on the lower tool portion 42 may be similar to the female threading 58 on the upper tool portion 40. That is, both female threadings 58 and 82 may have the same handedness (i.e., rotational motion in one direction may advance both threadings 58 and 82, while rotational motion in the opposite direction extracts the threadings 58 and 82).

Figure 4:
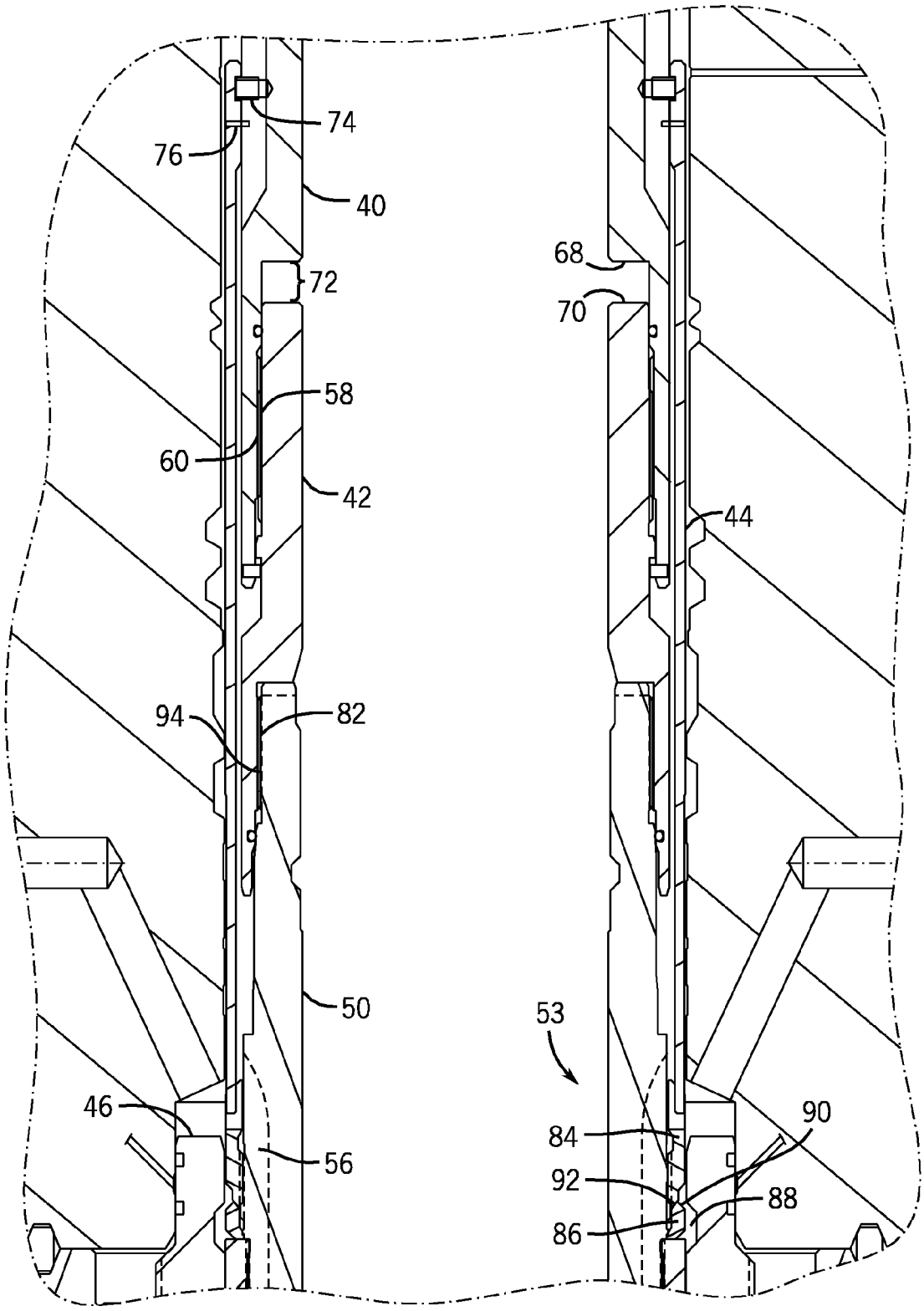
FIG. 4 is a close-up cross-sectional view of the exemplary wellhead components of FIG. 2 denoted by a line 4-4 in accordance with an embodiment of the present invention.

Turning now to FIG. 4, a close-up view of the one-trip tool 28 and the coupling 53 of FIG. 2 are illustrated. The coupling 53 includes an energizing ring 84 and a locking ring 86 disposed around the tubing hanger 50. In addition, a complimentary locking slot 88 (e.g., annular groove) is located on an interior surface of the casing hanger 46. The tubing hanger 50 is coupled to the casing hanger 46 when the locking ring 86 expands radially into the locking slot 88. Expansion of the locking ring 86 is accomplished by downward axial movement of the energizing ring 84. That is, corresponding tapers 90 and 92 on the energizing ring 84 and the locking ring 86, respectively, slide past one another as the energizing ring 84 is moved axially downward, thereby pushing the locking ring radially outward. The energizing ring 84 may be moved axially by the energizing sleeve 44 of the one-trip tool 28, as described in more detail below. Upon initial running-in of the tubing hanger 50, the locking ring 86 is in the unlocked position (e.g., radially inward, in an unexpanded state), with the energizing ring 84 disposed axially above the locking ring 86 and the energizing sleeve 44 disposed axially above the energizing ring 84, as illustrated in FIG. 4. In addition, the one-trip tool 28 is initially adjusted such that the ends 68 and 70 of the upper and lower tool portions 40 and 42, respectively, are not axially abutting, thereby leaving the gap 72 open. The female threading 82 on the interior of the lower tool portion 42 is coupled to male threading 94 on an exterior surface of the tubing hanger 50.

Figure 5:
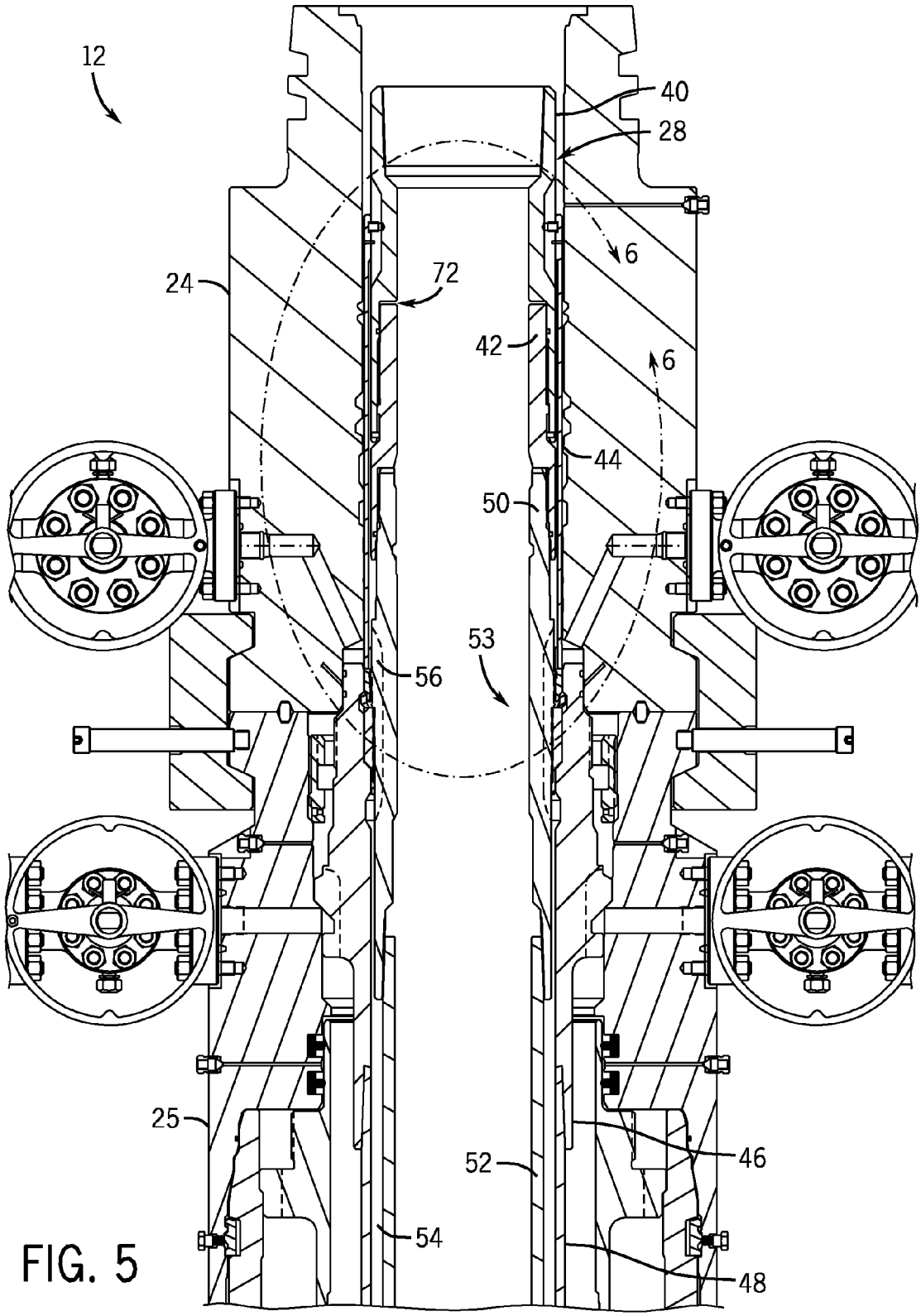
FIG. 5 is a cross-sectional view of the exemplary wellhead components of FIG. 2 in another configuration in accordance with an embodiment of the present invention.
Figure 6:
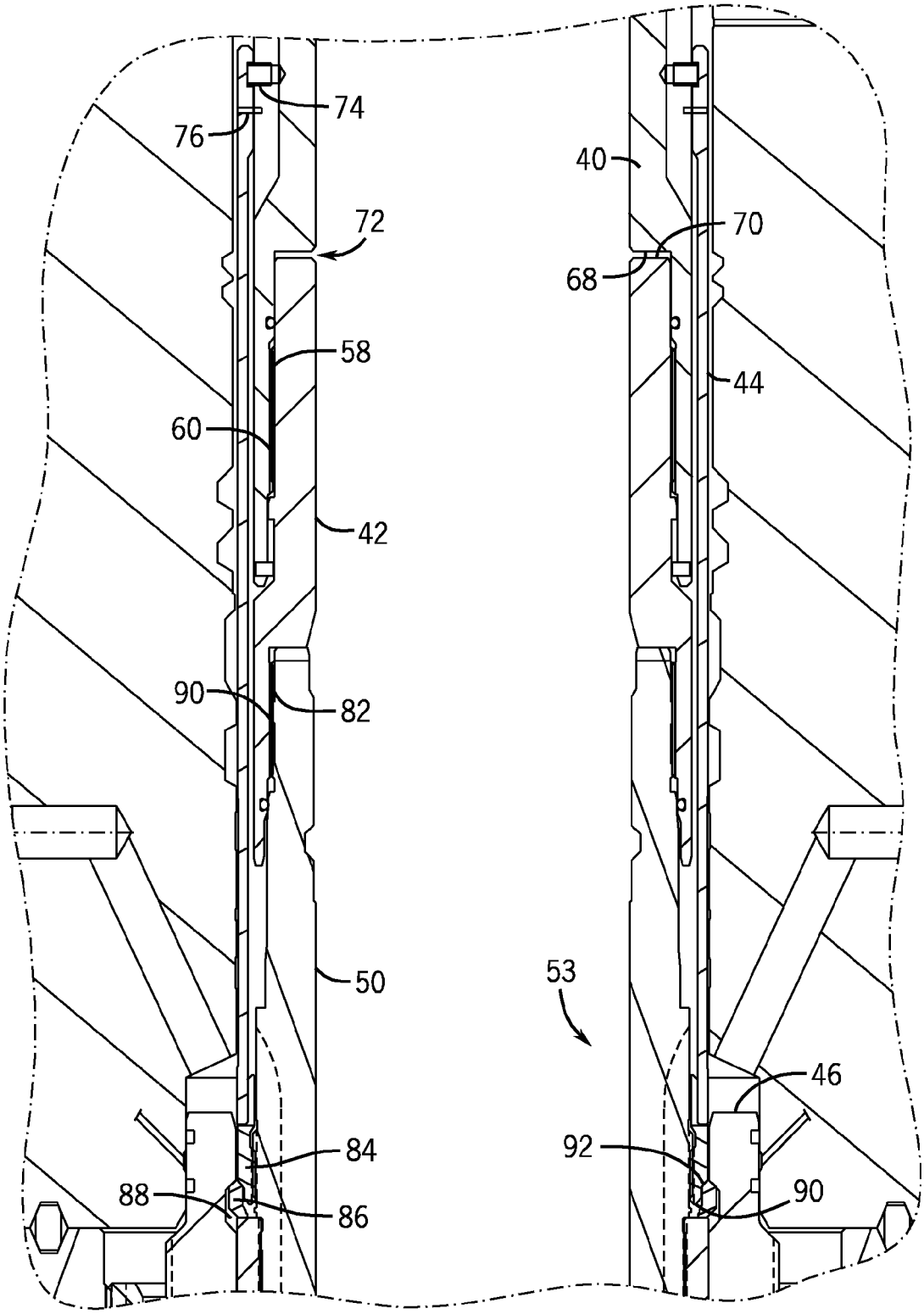
FIG. 6 is a close-up cross-sectional view of the exemplary wellhead components of FIG. 5 denoted by a line 6-6 in accordance with an embodiment of the present invention.

After the tubing hanger 50 has been run into and landed in the casing hanger 46, the coupling 53 may be engaged, as illustrated in FIGS. 5 and 6. FIG. 5 illustrates a cross-section of the wellhead 12, and FIG. 6 is a close-up view of the one-trip tool 28 and the coupling 53 of FIG. 5. To engage the coupling 53, the upper portion 40 of the one-trip tool 28 may be rotated to advance the energizing sleeve 44 axially downward. That is, torque may be applied to the upper tool portion 40 (e.g., by a tool coupled thereto), and the female threads 58 thereon may engage the male threads 60 to advance the upper portion 40 with respect to the lower portion 42, as illustrated by the reduction of the gap 72. In the illustrated embodiment, rotation of the upper tool portion 40 is conveyed to the threads 58 and 60 because the threads 82 and 94 are already fully engaged. That is, rotation of the tool 28 does not further engage the female threads 82 with the male threads 94 or advance the lower tool portion 42 relative to the tubing hanger 50. Rather, the rotational motion is conveyed to the threads 58 and 60 to move the upper tool portion 40 axially downward with respect to the wellhead 12. Axial movement of the upper tool portion 40 may be stopped when the lower end 68 of the upper tool portion 40 abuts the upper end 70 of the lower tool portion 42.

As noted above, the energizing sleeve 44 is coupled to the upper tool portion 40 by one or more set screws 74. Accordingly, when the upper tool portion 40 advances into the wellhead, so too does the energizing sleeve 44. The energizing sleeve 44 is disposed axially above the energizing ring 84 when the tubing hanger 50 is initially run into the wellhead 12 (FIGS. 2 and 4). Therefore, when the energizing sleeve 44 is advanced further into the wellhead 12, the energizing ring 84 is also advanced axially downward. As previously discussed, the tapers 90 and 92 on the energizing ring 84 and the locking ring 86, respectively, move past one another as the energizing ring 84 moves axially downward. The locking ring 86 is consequently pushed radially outward by the energizing ring 84 into the locking slot 88. After the locking ring 86 is fully engaged in the locking slot 88, additional torque may be applied to the upper tool portion 40 to shear the shear pins 76.

Optionally, the one-trip tool 28 may then be over-pulled to verify that the coupling 53 engaged properly. Over-pulling may involve exerting an upward force on the one-trip tool 28 that is greater than the weight of the tubing 52. If the tubing hanger 50 is displaced by the over-pull force, then this indicates that the coupling 53 was not properly engaged. The over-pull procedure ensures that the tubing hanger 50 was properly landed in and coupled to the casing hanger 46 before the cementing process is initiated.

After the tubing hanger 50 is locked in place within the wellhead 12, it may be further cemented in place. Cementing a wellhead component within the wellhead 12 ensures that the component will not move within the wellhead 12 during the mineral extraction process. For example, very high pressures exceeding 10,000, 15,000, or even 20,000 psi may be exerted on the wellhead components from the well bore 20 (FIG. 1). Cementing the wellhead components together provides support in addition to the internal locks, such as the coupling 53. Accordingly, cement may be pumped into the wellhead 12 through the drill string 30 (FIG. 1), the one-trip tool 28, the tubing hanger 50, and the tubing 52 to a cementing valve (not shown). From the cementing valve, the cement may be pushed back up the wellhead 12 through the annular space 54. The fluted exteriors, flow-through slots, and/or flow-through bores on the wellhead components (e.g., fluted exterior 56, flow-through slots 78, and fluted exterior 80) may facilitate the flow of cement back up the wellhead 12. For example, the fluted exterior 56 may enable cement to flow axially upward past the coupling 53.

Figure 7:
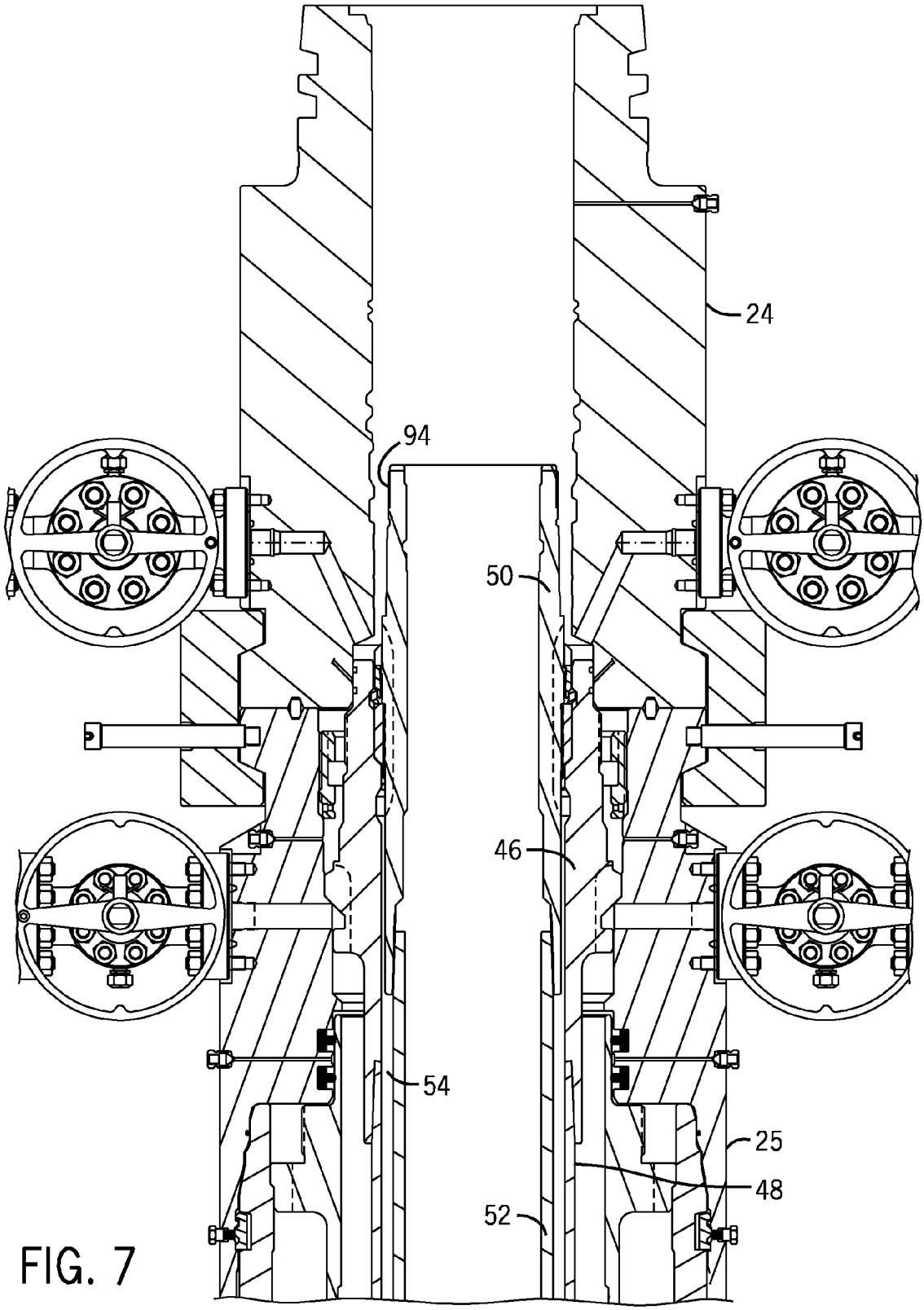
FIG. 7 is a cross-section view of the exemplary wellhead component of FIG. 2 with the one-trip tool removed.

When the wellhead components are cemented in place, the one-trip tool 28 may be retrieved from the wellhead 12, as illustrated in FIG. 7. Disengagement of the tool 28 from the tubing hanger 50 may be accomplished by rotation of the tool 28 to disengage the female threads 82 from the male threads 94. This rotation may be in the opposite direction of the rotation employed to advance the upper tool portion 40, as previously described. Additional components may then be run into the wellhead to complete the installation and prepare the well for production.

Figure 8:
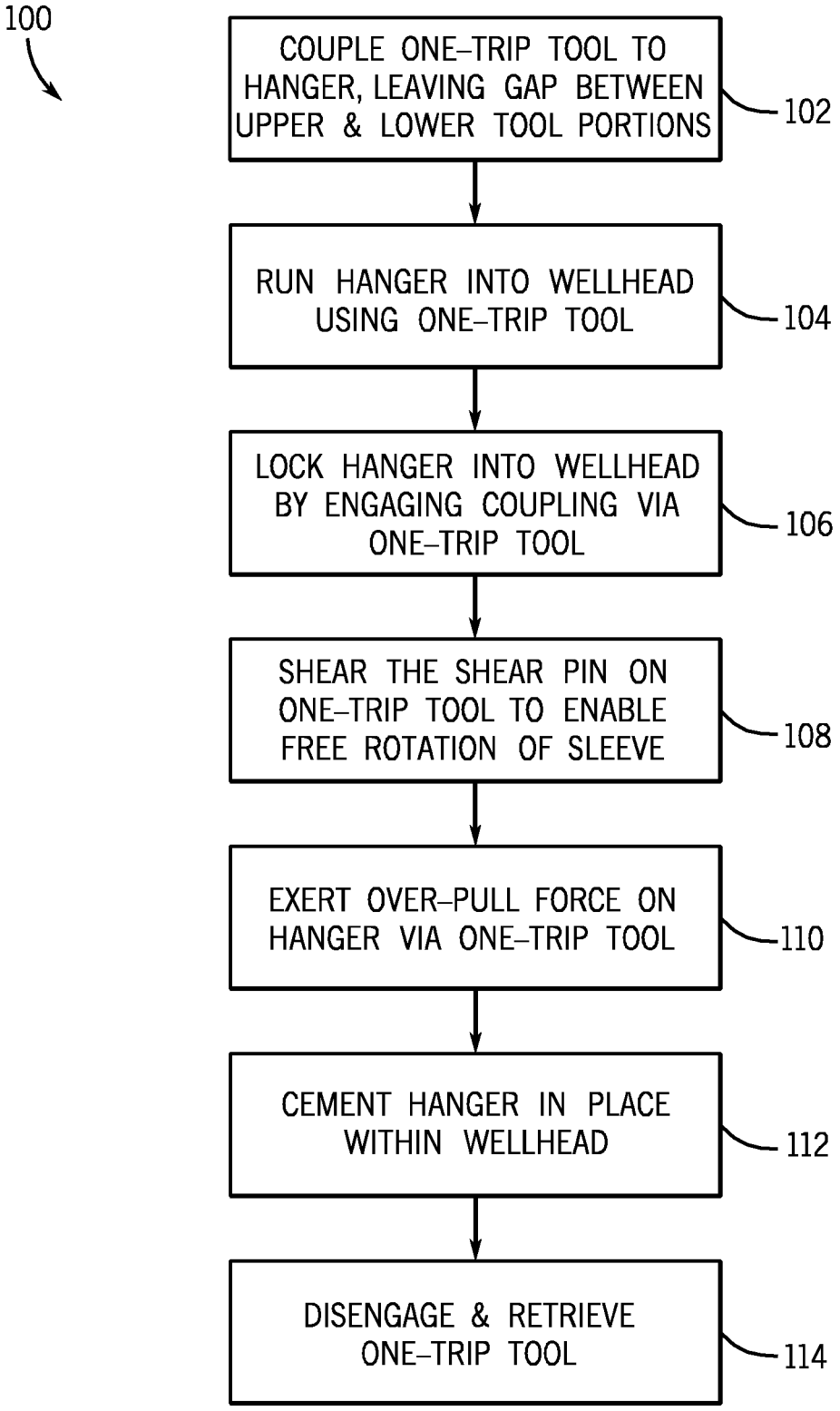
FIG. 8 is a flow chart of an exemplary process for installing a wellhead component using the one-trip tool of FIG. 3 in accordance with an embodiment of the present invention.

FIG. 8 illustrates a flow chart of an exemplary process 100 for utilizing the one-trip tool 28. The tool 28 may be coupled to the hanger 50 via engagement of the threadings 82 and 94 (block 102). In addition, the one-trip tool 28 may be adjusted such that the gap 72 between the upper tool portion 40 and the lower tool portion 42 is large enough that the energizing sleeve 44 is not exerting pressure on the energizing ring 84. The hanger 50 may then be run into the wellhead 12 using the one-trip tool 28 coupled to a drill string 30 (block 104). The coupling 53 may be engaged to lock the hanger 50 into the wellhead 12 (block 106). That is, torque may be applied to the upper tool portion 40, thereby moving the energizing sleeve 44 in an axial downward direction. Axial downward movement of the energizing sleeve 44 may then apply an axial downward force on the energizing ring 84, which in turn pushes the locking ring 86 radially outward to engage the locking slot 88. After the coupling 53 is fully locked, the shear pin 76 may be sheared by applying additional torque to the upper tool portion 40 (block 108). An over-pull force may then be exerted on the hanger 50, for example, by pulling on the drill string 30 with a force greater than the weight of the tubing 52 extending from the hanger 50 (block 110). If the hanger 50 is properly locked in place, the over-pull should not move the hanger 50 within the wellhead 12. If the hanger 50 is retracted by the over-pull force, the coupling process may be repeated. After the coupling 53 has been verified, the hanger 50 may be cemented in place within the wellhead 12 (block 112). The one-trip tool 28 may then be disengaged (i.e., via rotation of the tool 28 with respect to the hanger 50) and retrieved from the wellhead 12 (block 114).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method, comprising:

coupling a one-trip tool to a tubular via rotation of the tool with respect to the tubular in a first direction, wherein the one-trip tool comprises:

an upper tool portion;

a lower tool portion coupled to the upper tool portion, wherein the upper tool portion is axially moveable with respect to the lower tool portion; and an energizing sleeve coupled to the upper tool portion, wherein the energizing sleeve is axially fixed with respect to the upper tool portion;

engaging a coupling to secure the tubular within a wellhead by downward axial movement of the energizing sleeve via rotation of the upper tool portion with respect to the lower tool portion in the first direction; and uncoupling the one-trip tool from the tubular via rotation of the one-trip tool with respect to the tubular in a second direction opposite the first direction.

2. The method of claim 1, wherein engaging the coupling comprises outward radial movement of a locking ring component of the coupling in response to the downward axial movement of the energizing sleeve to bias an energizing ring against the locking ring.

3. The method of claim 1, comprising exerting an upward axial force on the tubular via the one-trip tool, wherein the upward axial force is greater than the weight of the tubular.

4. The method of claim 1, comprising pumping cement into the wellhead via the one-trip tool.

5. A mineral extraction system, comprising:

a one-trip tool, comprising:

an upper tool portion comprising a first female threading;

a lower tool portion comprising:

a first male threading configured to be engaged with the first female threading; and a second female threading; and an energizing sleeve coupled to the upper tool portion and disposed concentrically about the upper tool portion and the lower tool portion;

wherein:

the first and second female threadings have the same handedness;

the upper and lower tool portions are configured to move axially relative to one another via rotation of the upper tool portion with respect to the lower tool portion; and the energizing sleeve is configured to move axially with respect to the lower tool portion when the upper tool portion is rotated with respect to the lower tool portion.

6. The mineral extraction system of claim 5, wherein the upper tool portion is configured to be coupled to a drill string.

7. The mineral extraction system of claim 5, wherein the lower tool portion is configured to be coupled to a tubular via the second female threading.

8. The mineral extraction system of claim 7, comprising the tubular.

9. The mineral extraction system of claim 8, wherein the tubular comprises a coupling mechanism configured to secure the tubular within a wellhead and configured to be engaged by the energizing sleeve.

10. The mineral extraction system of claim 5, wherein the energizing sleeve is configured to engage a coupling internal to the mineral extraction system to secure a first wellhead component to a second wellhead component.

11. The mineral extraction system of claim 5, wherein the upper tool portion comprises one or more axial grooves on an exterior surface thereof.

12. The mineral extraction system of claim 5, wherein the upper tool portion comprises one or more generally axial bores through an exterior wall thereof.

13. The mineral extraction system of claim 5, wherein a wall of the energizing sleeve comprises one or more slots to enable fluid flow therethrough.

14. A mineral extraction system, comprising:

a coupling configured to secure a tubular within a wellhead, the coupling comprising:

a locking ring configured to be disposed around the tubular and to expand radially outward from the tubular into a locking slot within the wellhead; and an energizing ring configured to be disposed axially above the locking ring around the tubular and to exert an outward radial force on the locking ring via axial downward movement of the energizing ring; and a one-trip tool, comprising:

an upper tool portion configured to be secured to a drill string and comprising a first threading portion;

a lower tool portion configured to be secured to the first threading portion of the upper tool portion via a second threading portion and configured to be secured to the tubular via a third threading portion;

an energizing sleeve coupled to the upper tool portion and configured to exert an axial downward force on the energizing ring of the coupling to impart the axial downward movement to the energizing ring, thereby expanding the locking ring radially outward into the locking slot;

wherein:

the lower tool portion is configured to be secured to the tubular via rotation of the lower tool portion with respect to the wellhead component in a first direction;

the upper tool portion is configured to be secured to the lower tool portion via rotation of the upper tool portion with respect to the lower tool portion in the first direction; and the energizing sleeve is configured to move in a downward axial direction via rotation of the upper tool portion with respect to the lower tool portion in the first direction.

15. The mineral extraction system of claim 14, wherein the one-trip tool is configured to be unsecured from the tubular via rotation of the one-trip tool with respect to the tubular in a second direction opposite the first direction.

16. The mineral extraction system of claim 14, wherein the one-trip tool comprises one or more axial grooves on an exterior surface of the upper tool portion.

17. The mineral extraction system of claim 14, wherein the one-trip tool comprises one or more generally axial bores through an exterior wall of the upper tool portion.

18. The mineral extraction system of claim 14, wherein the one-trip tool comprises one or more slots through a wall of the energizing sleeve.

19. A method, comprising:

running a wellhead component into a wellhead with a tool, wherein running the wellhead component into the wellhead with the tool comprises coupling the tool to the wellhead component via a first threading having a first handedness;

engaging an internal coupling via the tool to lock the wellhead component in place within the wellhead, wherein engaging the internal coupling via the tool comprises rotating a first tool portion with respect to a second tool portion to thereby move an energizing sleeve in an axial downward direction to engage an energizing ring of the internal coupling, wherein the first and second tool portions are coupled together via a second threading having the first handedness;

exerting an over-pull force on the wellhead component via the tool; and pumping cement into the wellhead via the tool;

wherein the recited steps are performed in a single trip of the tool.

20. A method, comprising:

coupling components of a one-trip tool configured to be coupled to a tubular and a drill string, the one-trip tool comprising:

an upper tool portion configured to be coupled to the drill string;

a lower tool portion configured to be coupled to the tubular; and an energizing sleeve configured to engage a coupling to lock the tubular in place within the wellhead;

wherein coupling components of the one-trip tool comprises:

coupling the upper tool portion to the lower tool portion via a first threading having a first handedness, wherein the lower tool portion is configured to be coupled to the tubular via a second threading having the first handedness; and coupling the energizing sleeve to the upper tool portion such that rotation of the upper tool portion with respect to the lower tool portion produces axial movement of the energizing sleeve with respect to the lower tool portion, wherein the upper tool portion and the lower tool portion are configured to be only partially threaded together when the tubular is run into the wellhead.

* * * * *